US008794563B2

(12) United States Patent
Lai et al.

(10) Patent No.: US 8,794,563 B2
(45) Date of Patent: Aug. 5, 2014

(54) INTEGRATED CONNECTOR ASSEMBLY FOR A ROTARY APPARATUS

(75) Inventors: Kam Kwong Lai, Kwai Chung (HK); Kin Man Lee, Kwai Chung (HK); Wai Ho Luoie, Kwai Chung (HK); Leung Por Chan, Kwai Chung (HK); Wang Lung Tse, Kwai Chung (HK)

(73) Assignee: ASM Assembly Automation Ltd, Hong Kong (HK)

( * ) Notice: Subject to any disclaimer, the term of this patent is extended or adjusted under 35 U.S.C. 154(b) by 925 days.

(21) Appl. No.: 12/781,015

(22) Filed: May 17, 2010

(65) Prior Publication Data

US 2011/0280702 A1 Nov. 17, 2011

(51) Int. Cl.

| | |
|---|---|
| ***B65H 75/38*** | (2006.01) |
| ***B65H 23/04*** | (2006.01) |
| ***B65H 75/44*** | (2006.01) |

(52) U.S. Cl.

USPC ..... 242/603; 242/407; 242/388; 174/47; 174/72 A; 439/164

(58) Field of Classification Search

USPC ..... 118/503; 137/355.17, 355.22, 580; 174/69, 72 A; 187/262; 212/319, 321, 212/322, 332; 242/388, 388.6; 248/59; 254/278, 283, 285, 336, 337, 900; 269/578; 414/758

See application file for complete search history.

(56) References Cited

U.S. PATENT DOCUMENTS

| | | | | | |
|---|---|---|---|---|---|
| 3,493,009 | A * | 2/1970 | Richardson | ..... | 137/355.17 |
| 4,071,205 | A * | 1/1978 | Wieschel | ..... | 242/602.2 |
| 5,050,813 | A * | 9/1991 | Ishikawa et al. | ..... | 242/405.1 |
| 5,183,218 | A * | 2/1993 | Gavagna | ..... | 242/388 |
| 6,000,902 | A * | 12/1999 | Mueller et al. | ..... | 414/758 |
| 6,143,985 | A * | 11/2000 | Knapp et al. | ..... | 174/69 |
| 6,340,126 | B1 * | 1/2002 | McAlpine et al. | ..... | 242/160.2 |
| 6,396,414 | B1 * | 5/2002 | Bickford et al. | ..... | 340/855.2 |
| 7,344,156 | B2 * | 3/2008 | Suzuki et al. | ..... | 280/775 |
| 8,376,339 | B2 * | 2/2013 | Nagai et al. | ..... | 269/57 |
| 2006/0231812 | A1 * | 10/2006 | Ziech et al. | ..... | 254/278 |
| 2008/0225534 | A1 * | 9/2008 | Rus et al. | ..... | 362/404 |
| 2009/0200722 | A1 * | 8/2009 | Nakano et al. | ..... | 269/61 |

FOREIGN PATENT DOCUMENTS

| | | | | | |
|---|---|---|---|---|---|
| JP | 2002273630 | A * | 9/2002 | ..... | B23Q 1/25 |
| JP | 2007229904 | A * | 9/2007 | | |
| WO | WO 2010029670 | A1 * | 3/2010 | | |

* cited by examiner

*Primary Examiner* — Gregory Adams
(74) *Attorney, Agent, or Firm* — Ostrolenk Faber LLP

(57) ABSTRACT

A rotary apparatus comprises a rotary bobbin, a processing component fixedly attached to the bobbin and connectors fixedly connected to the processing component. At least one helical groove is located along the bobbin wherein the connectors are housed. A motor coupled to the processing component is operative to rotate the processing component together with the bobbin in two opposite rotary directions.

10 Claims, 2 Drawing Sheets

INTEGRATED CONNECTOR ASSEMBLY FOR A ROTARY APPARATUS

FIELD OF THE INVENTION

The present invention relates to the integration of connectors such as power cables and pneumatic hoses, and in particular to integrating connectors that are required for the operation of a rotary apparatus.

BACKGROUND AND PRIOR ART

The processing of electronic components in the semiconductor industry sometimes involves rotational motion of a process station on which electronic components are mounted or held. The process station may comprise a rotary support which undergoes rotary motion in clockwise and/or anticlockwise directions. Particularly, connectors such as electrical cables and pneumatic hoses are often joined to the process station in order to provide power and various functions to the rotary support for processing the electronic components.

For instance, the electrical cables may supply electrical power and carry sensing signals to a heater module of the process station. The cables may also carry control signals from a motor driver to either a servo motor or a stepper motor coupled to the rotary support in order to drive the support to rotate. Pneumatic hoses or vacuum lines are sometimes connected to provide vacuum suction or pressurized air to the rotary support. Pneumatic hoses may also carry compressed air to drive the servo motor or stepper motor coupled to the rotary support.

In a typical process, a processing station may be subjected to different processing conditions such as heating, actuator control, temperature control and rotational motion. Electronic components on a rotary support may be heated with power ranging from 200 mW to 2 kW to a temperature range of 40 to 500° C., and may need to be rotated at speeds of 10 to 10000 rpm. Cables and hoses connected to the rotary support supply the necessary input to create the conditions for carrying out such functions.

During rotational motion, the rotating support may cause extensive friction and tension to the cables and pneumatic hoses which are rigidly connected to the support. To provide proper manipulation of the connectors in a rotary environment, helical cables and springs are conventionally used as mounts for the hoses and cables connected to the support. Reliability issues may arise when an assembly of connectors mounted this way has been stressed by stretching for a prolonged period during use. The connectors may also become entangled and/or turn brittle as the connectors rotate with the rotating support. A stiff spring which carries heavy bundles of cables and hoses may also experience undesirably heavy recoil which brings about stress to the connectors and damages the bundled wiring.

Another type of integrated connector assembly is in the form of a linear energy chain. However, such an arrangement requires a relatively large area for manipulation of the linear energy chain, the inside of which is retracted and straightened during moving strokes. Furthermore, rotational movement may be inhibited due to mechanical constraints posed by the presence of adjacent modules. Therefore, the linear energy chain is usually not employed in environments where there are space constraints, such as inside compact semiconductor processing machinery.

The conventional arrangements of cables and hoses are therefore undesirable, especially when there are space constraints. In light of the disadvantages of the prior art as described above, it would be desirable to provide a compact integrated connector assembly which avoids the above limitations when it is used in association with a rotary apparatus or processing component.

SUMMARY OF THE INVENTION

It is thus an object of the invention to seek to provide an integrated connector assembly which is tailored for use with a rotary apparatus in a compact environment.

According to a first aspect of the invention, there is provided a rotary apparatus comprising: a rotary bobbin; a processing component fixedly attached to the bobbin and connectors fixedly connected to the processing component; at least one helical groove located along the bobbin wherein the connectors are housed; and a motor coupled to the processing component which is operative to rotate the processing component together with the bobbin in two opposite rotary directions.

According to a second aspect of the invention, there is provided a connector assembly for a rotary apparatus comprising a processing component and a motor coupled to the processing component which is operative to rotate the processing component in two opposite rotary directions, the connector assembly comprising: a rotary bobbin fixedly attached to the processing component which rotates together with the processing component; connectors fixedly connected to the processing component; and at least one helical groove located along the bobbin wherein the connectors are housed.

It will be convenient to hereinafter describe the invention in greater detail by reference to the accompanying drawings. The particularity of the drawings and the related description is not to be understood as superseding the generality of the broad identification of the invention as defined by the claims.

BRIEF DESCRIPTION OF THE DRAWINGS

The present invention will be readily appreciated by reference to the detailed description of a preferred embodiment of the invention when considered with the accompanying drawings, in which.

DETAILED DESCRIPTION OF THE PREFERRED EMBODIMENT OF THE INVENTION

The preferred embodiment of the present invention will be described hereinafter with reference to the accompanying drawings.

Figures 1, 2:
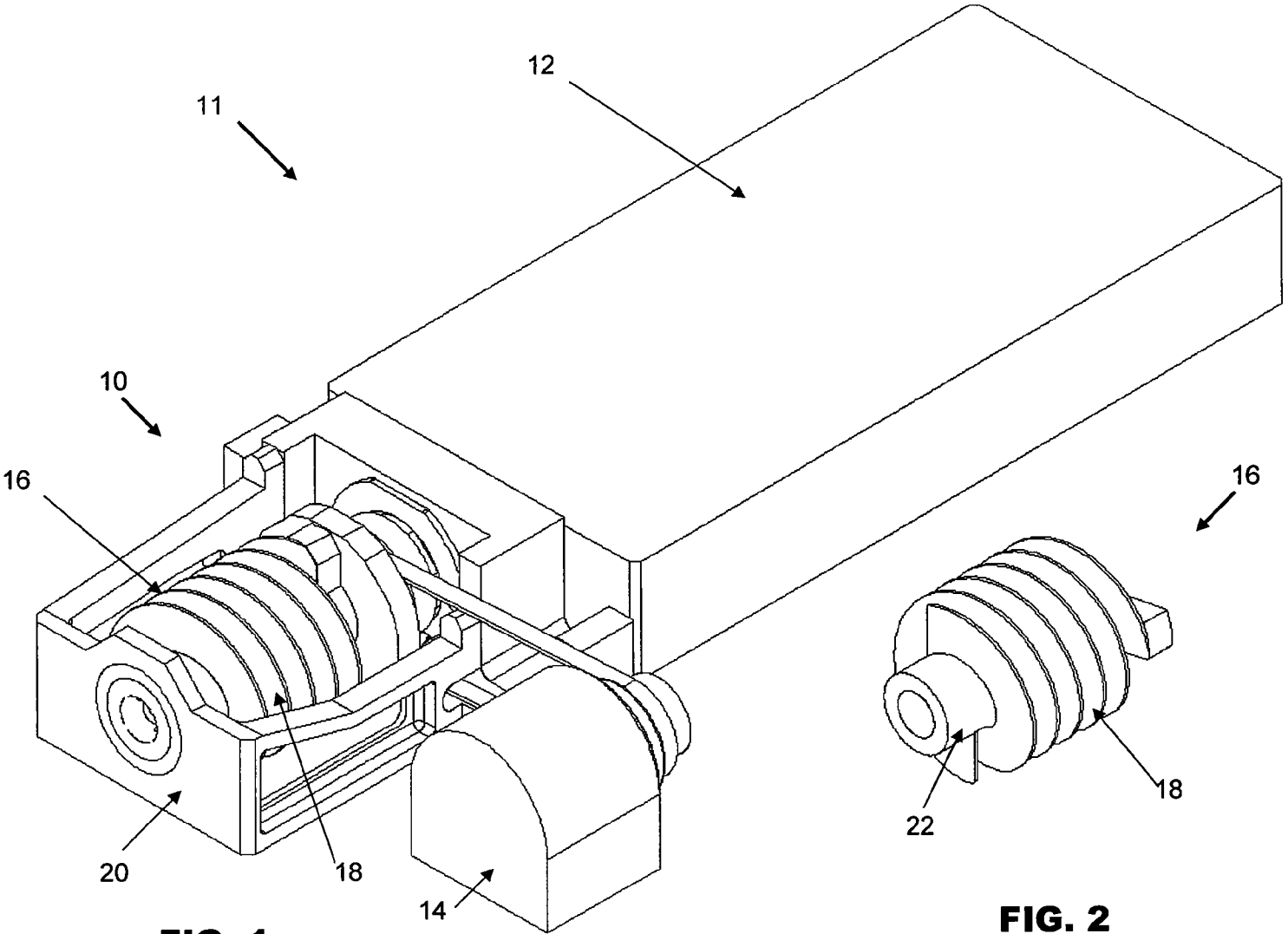
FIG. 1 is an isometric view of a rotary apparatus comprising a connector assembly according to the preferred embodiment of the invention.
FIG. 2 is an isometric view of a helical bobbin of the connector assembly of FIG. 1.

FIG. 1 is an isometric view of a rotary apparatus 11 comprising a connector assembly 10 according to the preferred embodiment of the invention. The connector assembly 10 is located adjacent to a processing component 12 of the rotary apparatus 11. The processing component 12 may be a rotary table or a flipper unit 12 operative to hold and flip semiconductor devices to different orientations. The connector assembly 10 comprises a helical bobbin 16 that is adapted to rotate and an integrated assembly of connectors mounted thereon. Both the helical bobbin 16 and the connectors are fixedly attached to the processing component 12.

The helical bobbin 16 comprises a spindle around which the connectors are wound and may include one or more helices of spiraling trenches or helical grooves 18 along the longitudinal or rotary axis of the spindle. The connectors may include power cables, sensor cables, control wirings and air or pneumatic hoses, which are housed in and wound along the one or more helical grooves 18. Hence, the connector assembly 10 is an integrated wiring unit mounted on the helical bobbin 16 to provide connectors for various control and heating functions for semiconductor processing components which are to be rotated. The connector assembly 10 further comprises a mounting support 20 which supports the helical bobbin 16 and has inlets and outlets located at opposite ends of the helical bobbin 16 for allowing the connectors to be introduced into the helical grooves 18 and for exiting the helical grooves 18. A protective cover (not shown) covers the connector assembly 10 so that the connector assembly 10 is free from particulate contamination.

In the preferred embodiment, the helical bobbin 16 is rigidly attached to a shaft of the flipper unit 12 so that the helical bobbin 16 rotates together with the flipper unit 12. A belt couples an actuation motor 14 to the flipper unit 12 to operatively rotate the flipper unit 12 together with the helical bobbin 16 in two opposite rotary directions. Due to the rigid attachment, when the flipper unit 12 rotates, the helical bobbin 16 rotates correspondingly in the same direction and by the same degree. In particular, the helical bobbin 16 turns with the flipper unit 12 so that there is very little tension on the coiled cables and hoses in the grooves 18. This reduction or absence of tension prolongs the lifespan of the cables and air or pneumatic hoses which are wound around the helical bobbin 16.

In this way, the connector assembly 10 functions as a platform to interconnect external utilities such as the AC supply line and compressed air to the flipper unit 12. Effective control when turning cables and hoses, thermal sensors, vacuum lines, compressed air supplies and heaters connected to the components of a rotary table of the flipper unit 12 can thus be achieved even if there are space constraints in a rotary environment.

FIG. 2 is an isometric view of the helical bobbin 16 of the connector assembly 10 of FIG. 1. The preferred helical bobbin 16 includes at least two separate helical grooves 18 arranged adjacent to and parallel to each other and which are arranged in the form of a double-helix. One of the helical groove 18 may house a first type of connectors comprising various electrical cables and the other helical groove 18 may house a second type of connectors comprising air or pneumatic hoses and vacuum lines. The different types of connectors are therefore separately fitted into each helical groove 18 along the helical bobbin 16. A shaft 22 centrally extending along the longitudinal axis of the helical bobbin 16 serves to rigidly connect the helical bobbin 16 to the flipper unit 12. Thus, when the flipper unit 12 turns, the helical bobbin 16 turns correspondingly.

As a consequence, the cables and hoses arranged in the helical grooves 18 are alternately tightened and loosened during rotation of the shaft 22 so that very little tension is experienced. The connector assembly 10 may therefore experience large angles of rotational motion in both clockwise and anticlockwise directions together with the flipper unit 12 without causing undue tension to the connectors contained therein.

Figure 3A:
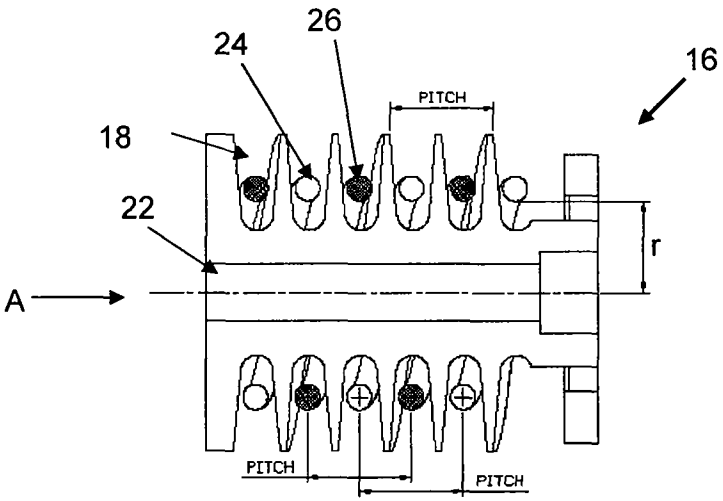
FIGS. 3A and 3B are cross-sectional views of the helical bobbin of FIG. 2 comprising double helices accommodating dual connectors such as a power cable and a pneumatic hose.
Figure 3B:
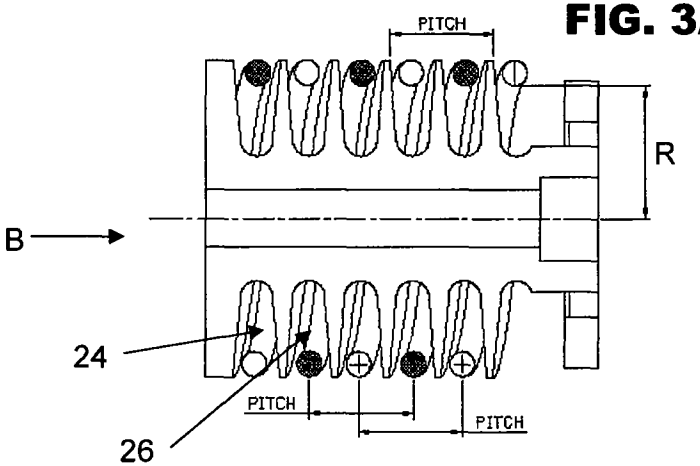

FIGS. 3A and 3B are cross-sectional views of the helical bobbin 16 of FIG. 2 comprising double helices accommodating dual connectors, such as a power cable 24 and a separate air hose or pneumatic hose 26, which are wound around the helical bobbin 16 along separate helical pathways. It should be noted that separation of the power cable 24 and the pneumatic hose 26 further assists in preventing entanglement, and also prevents heat from the power cable 24 from directly affecting the pneumatic hose 26.

As illustrated in FIGS. 3A and 3B, the power cable 24 and pneumatic hose 26 are wound around the grooves 18 along two separate helical paths, the pitch of the connector assembly 10 being a distance across a width of two grooves 18. The shape and depth of each groove 18 in the double helices are specially designed to provide a suitable profile to fit the coils 24, 26 within the grooves 18 at all times.

During rotation of the connector assembly 10, the power cable 24 and pneumatic hose 26 are alternately tightened and loosened as exhibited in FIG. 3A and FIG. 3B respectively. In a relatively loosened state (see FIG. 3B), the power cable 24 and pneumatic hose 26 take up more space in the groove 18 and hence the lengths of the power cable 24 and pneumatic hose 26 located inside the grooves 18 are at their maximum. Comparatively, when the power cable 24 and pneumatic hose 26 are in a relatively tightened state (see FIG. 3A), the lengths of the power cable 24 and pneumatic hose 26 which are located inside the grooves 18 are at their minimum.

The protective cover of the helical bobbin 16 further helps to contain the cables and pneumatic hoses inside the helical bobbin 16. The clearance between the protective cover and the spindle of the helical bobbin 16 accommodates the difference in length between the maximum and minimum lengths of the power cable 24 and pneumatic hose 26 contained within the connector assembly 10 in the respective loosened and tightened states as described above. Separation of the power cable 24 and pneumatic hose 26 which are coiled on the helical bobbin 16 prevents entanglement and ensures that rotational movement of the flipper unit 12 does not damage the power cable 24 and pneumatic hose 26.

Figure 4A:
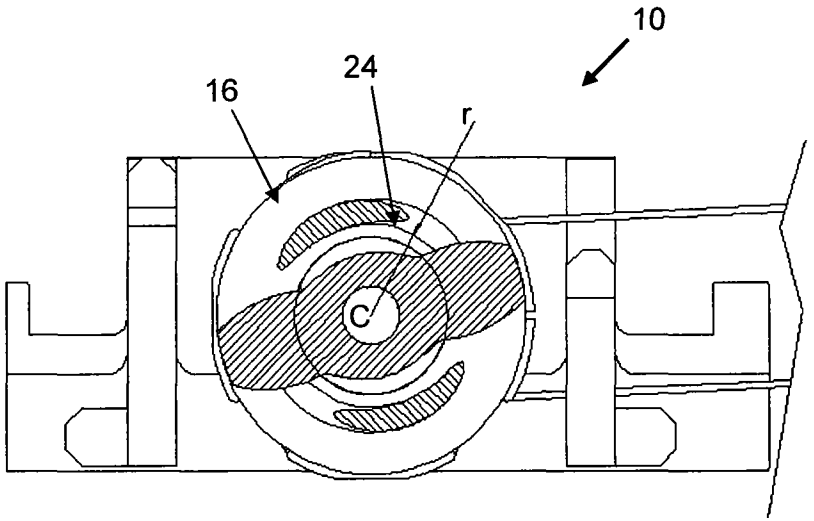
FIGS. 4A and 4B are end views of the helical bobbin looking from direction A of FIG. 3A and from direction B of FIG. 3B respectively.
Figure 4B:
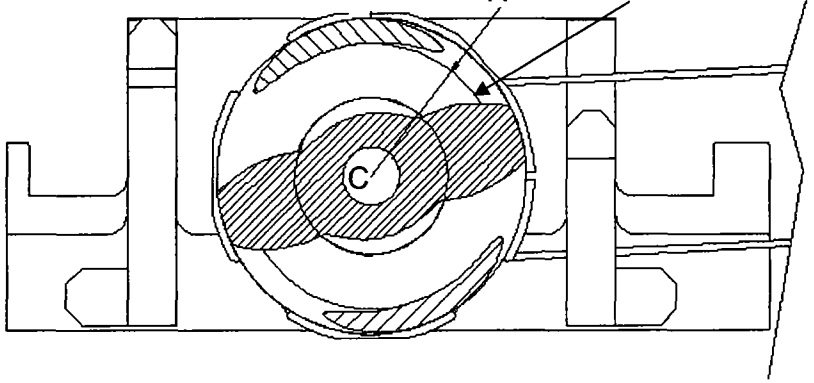

FIGS. 4A and 4B are end views of the helical bobbin 16 looking from direction A of FIG. 3A and from direction B of FIG. 3B respectively. FIG. 4A illustrates a relatively tightened state of the cable 24 and hose 26 at one extremity of rotation of the helical bobbin 16 in a clockwise direction such that the cable 24 and hose 26 are spaced at a radius r from the centre of rotation C of the helical bobbin 16. The radius r is greater than a radius of the spindle of the helical bobbin 16 so that the cable 24 and hose 26 are generally spaced from the spindle of the bobbin in this relatively tightened state.

FIG. 4B illustrates a relatively loosened state of the cable 24 and hose 26 at another extremity of rotation of the shaft 12 or the spindle of the helical bobbin 16 in an anticlockwise direction such that the power cable 24 and pneumatic hose 26 are spaced at a radius R from the centre of rotation C of the helical bobbin 16. The radius R in the loosened state is larger than the radius r in the tightened state. The depth of each groove 18 is greater than or equal to the radius R so that in both relatively tightened and loosened states of the power cable 24 and pneumatic hose 26, the depth of each groove 18 is sufficiently large to wholly contain the connectors within the groove 18 at all times during rotation of the flipper unit 12.

It should be appreciated that the connector assembly 10 comprising the helical bobbin 16 of the preferred embodiment of the invention described above provides a protected enclosure for holding connectors such as electrical cables, control wirings, thermal sensor cables like resistance temperature detector (RTD) wires and pneumatic hoses. The resulting connector assembly 10 is a neat and space-saving platform for semiconductor processing apparatus which requires rotary motion, and is especially useful when heating is required.

The helical bobbin 16 is configured to allow smooth flipping motion of a rotary table apparatus of a semiconductor processing machine while preventing connectors from becoming entangled to each other. By designing the double helix in accordance with an appropriate pitch and/or shape of grooves to contain the cables and hoses, there is flexibility in adopting different designs of cables and hoses for use. Winding the cables and hoses on the helical bobbin 16 of the preferred embodiment of the invention further permits rotational movement through angles of varying degrees, such as between 90 degrees and 360 degrees. Thus, the helical bobbin 16 permits smooth turning operation, ensures reduced tension on the power cables and pneumatic hoses inside the integrated connector assembly and prolongs the lifespan of the assembly.

The invention described herein is susceptible to variations, modifications and/or additions other than those specifically described and it is to be understood that the invention includes all such variations, modifications and/or additions which fall within the spirit and scope of the above description.

The invention claimed is:

1. A rotary apparatus comprising:

processing component;

a rotary bobbin fixedly attached to the processing component, the rotary bobbin being configured to mount a plurality of connectors on the rotary bobbin and the plurality of connectors being for connecting to the processing component; and a motor coupled to the processing component, the motor being operative to rotate the processing component together with the bobbin in two opposite rotary directions, wherein the rotary bobbin comprises a plurality of separate helical grooves for fitting the plurality of connectors separately into each helical groove, the helical grooves being arranged adjacent and parallel to each other in the form of a double-helix, and having a depth that allows the plurality of connectors to move inside the respective helical grooves when the rotary bobbin is rotating in the rotary directions, and the connectors are movable between a relatively loosened state, wherein a length of the connectors located inside the helical grooves is at a maximum, and a relatively tightened state, wherein a length of the connectors located inside the helical grooves is at a minimum, the connectors being located at a radius R from a center of rotation of the bobbin at one extremity of rotation in one direction in the relatively loosened state, and at a radius r from the center of rotation of the bobbin at another extremity of rotation in an opposite direction in the relatively tightened state, wherein R>r.

2. The rotary apparatus as claimed in claim 1, wherein the connectors comprise electrical cables or air hoses.

3. The rotary apparatus as claimed in claim 1, wherein a first type of connector is housed in one helical groove and a second type of connector is housed in a second helical groove located adjacent to and parallel to the first groove.

4. The rotary apparatus as claimed in claim 3, wherein the first type of connector comprises an electrical cable and the second type of connector comprises an air hose.

5. The rotary apparatus as claimed in claim 1, wherein the processing component is a flipper unit which is operative to hold and flip semiconductor devices to different orientations.

6. The rotary apparatus as claimed in claim 1, further comprising a mounting support for supporting the bobbin, the mounting support further comprising inlets located at one end of the bobbin for introducing the connectors into the at least one helical groove.

7. The rotary apparatus as claimed in claim 1, further comprising a belt coupling the motor to the processing component to drive the processing component to rotate.

8. The rotary apparatus as claimed in claim 1, further comprising a shaft extending centrally through the bobbin to connect the bobbin to the processing component.

9. The rotary apparatus as claimed in claim 1, wherein r is greater than a radius of a spindle of the bobbin such that the connectors are generally spaced from the spindle of the bobbin in the relatively tightened state.

10. The rotary apparatus as claimed in claim 1, wherein a depth of the helical grooves is greater than or equal to R.

* * * * *